US006981686B2

(12) United States Patent
McGuinness

(10) Patent No.: US 6,981,686 B2
(45) Date of Patent: Jan. 3, 2006

(54) MODULAR SUPPORT/ENCLOSURE WALL ASSEMBLY AND KIT

(75) Inventor: Hugh G. McGuinness, 76 Briar Ridge Rd., Danbury, CT (US) 06810

(73) Assignee: Hugh G. McGuinness, Danbury, CT (US)

( * ) Notice: Subject to any disclaimer, the term of this patent is extended or adjusted under 35 U.S.C. 154(b) by 0 days.

(21) Appl. No.: 10/177,466

(22) Filed: Jun. 20, 2002

(65) Prior Publication Data

US 2003/0234336 A1 Dec. 25, 2003

(51) Int. Cl.
*E04G 9/00* (2006.01)
*E02D 17/08* (2006.01)

(52) U.S. Cl. ..... 249/48; 52/81.3; 249/209; 405/282; 405/288

(58) Field of Classification Search ..... 52/87, 52/89, 127.7, 127.12, 81.1, 81.2, 81.3, 81.4; 264/32; 249/48, 49, 209; 405/151, 153, 405/288; 446/122, 123, 476, 478
See application file for complete search history.

(56) References Cited

U.S. PATENT DOCUMENTS 1,670,625 A * 5/1928 Johannesson ..... 405/152

* cited by examiner

*Primary Examiner*—Michael Safavi

(57) ABSTRACT

A conformable modular support/enclosure wall system incorporates a skin formed of modular sheet sections bolted to a skeleton or framework constructed of elongate rib elements that can be fastened, e.g. bolted, together in various relationships including end-to-end, side-to-end and side-to-side configurations. The rib elements are provided in a variety of lengths and wall arrangements and each element has a generally trapezoidal cross-section, with a similar trapezoidal appearance in side elevation. The rib elements include transverse slots and apertures as well as axial apertures all configured to receive bolt fasteners within a range of angular orientations relative to the axial and transverse axes of the ribs. The flexible sheet sections of the skin bear arrays of openings in the form of elongated slots arranged in coordinate grid patterns, with the slots alternately aligned with the x and y axes of the same or independent coordinate grids. Threaded hanger bars extending through one or more skin sections and through the slots and apertures in the ribs, serve to secure the skin to the ribs, using mating nuts threaded onto the hanger bars. Separate rib bolts extending through the slots and apertures in the ribs serve to secure the ribs to each other to form a skeleton or framework using rib nuts threaded onto the rib bolts.

16 Claims, 6 Drawing Sheets

MODULAR SUPPORT/ENCLOSURE WALL ASSEMBLY AND KIT

BACKGROUND OF THE INVENTION

1. Field of the Invention

This invention relates to modular wall assemblies of the type used for earth excavations, concrete forms and temporary enclosures. More specifically, the invention relates to a unique set of parts and materials that facilitate the assembly and disassembly of such walls in the widest possible variety of shapes and layouts with a minimum number of different parts.

2. Description of the Invention

Construction forms for pouring concrete, and shoring forms for supporting the earthen sides of excavations and the like have been well known and widely used for many years. Similarly, the walls used to define such forms can also be employed when desired to construct temporary enclosures for storing and protecting construction equipment and supplies. However, the forms and elements available for these purposes in the prior art are generally limited in adaptability and restricted in the shapes and layouts that can be achieved without extensive inventories of different parts and materials.

The present invention overcomes these problems and other limitations of the prior art by providing a set of construction elements comprising a limited number of standard parts that can be interconnected easily in many ways to define a wide variety of configurations. The shape of each part reduces the required number of differently shaped parts to a minimum while permitting the parts to be interconnected with each other in a maximum number of different alignments and orientations.

That is, the parts of the wall system of this invention in general comprise a plurality of differently sized but otherwise substantially identical elongate rib elements that are interconnectable with each other to define a supporting framework or skeleton, and a plurality sheet-like skin elements of tough, stiffly flexible material that than can be fastened readily to the skeleton to define the desired wall structure.

The rib elements of the system of this invention each include a variety of specifically shaped and located bolt-receiving openings that allow the insertion of rib bolts to secure the rib elements to each other. Similarly, the skin elements are perforated in a regular pattern to receive threaded hanger bolts that serve to fasten the skin to the skeleton. The heads of the hanger bolts and the perforations in the skin are specifically shaped to permit the heads to pass through the skin in both directions under certain circumstances, to facilitate assembly and disassembly of a wall structure.

SUMMARY OF THE INVENTION

The present invention discloses a wall construction system incorporating uniquely shaped elongate rib elements of various predetermined lengths that are bolted together to form a skeleton or framework that supports and defines the shape of the wall. The wall structure is completed by securing a skin of sheet-like skin elements to the skeleton framework formed by the ribs. The threaded bolts that serve to hold the rib elements and skin elements in assembled relationship are specifically adapted to the nature and configuration of those elements.

The rib elements are beam-like in nature, having generally a trapezoidal transverse cross-section and a generally trapezoidal axial cross section; in this regard, each beam may be considered to be characterized by a central axis extending along the length of the beam, and the transverse cross-section accordingly lies in a plane that is normal to the central axis while the axial cross-section lies in a plane that passes through the central axis. Aside from variations in the length of the ribs and variations in the number of apertures in each rib depending upon its length, all of the ribs are substantially identical to each other in each structure. The number of different length ribs needed to construct usable walls in accordance with the invention depends primarily upon the construction application in which the system is being used and the corresponding size and nature of the walls that must be formed. For relatively small scale-construction projects requiring simple concrete-pouring forms and reinforcement of comparatively small excavated earth walls, three to six different lengths of ribs may be sufficient, while larger projects or projects requiring particularly complex wall shapes may require dozens of different rib lengths.

The trapezoidal cross-sectional shape of the rib elements provides convergingly related side and end walls on each rib. These sloping walls can be abutted against each other in various relationships to achieve desired straight or angular joints between adjacent ribs. And, as a result of the placement and configuration of the bolt-receiving openings in each rib, abutting ribs can be bolted together firmly, independently of the skin elements, to sustain desired framework shape.

The skin elements that are fastened to the rib-based framework comprise sheets of tough, stiffly flexible material, such as sheet steel or the newer composite materials of the type being used at this time in the fabrication of aircraft and automobile bodies. Each sheet of skin material may be of any suitable size, and for convenience one or more standard sizes may be made available. It is expected that size will be determined generally by weight and/or dimensions that can be handled conveniently by manual workers with or without machinery to assist them. In accordance with this invention, each sheet of skin is characterized by a regular pattern of through-holes distributed over the surface of the skin element, for accepting passage of hanger-bolt elements that allow the skin to be "hung", that is anchored or fastened, to the skeletal framework of rib elements.

The remaining key elements of the invention are rib-bolts that serve to secure the rib elements together to form a framework, and hanger-bolts that are used to secure the skin elements to the framework of ribs. The threaded rib bolts may be conventional in nature with a head portion at one end and a "free" end opposite the head portion for permitting a conventional threaded nut element to be threadedly engaged with the external threads of the bolt. However, as will be made evident herein, it is believed that it will be preferable to use rib bolts having a "free end" at each end thereof so that either end may be inserted conveniently into a bolt-receiving opening of closely matching diameter and either end may then engage a corresponding internally threaded nut element to tighten the bolt to the structure containing the bolt-receiving opening. Both the rib bolts and the hanger bolts are fastened to the rib elements using threaded nut elements having conventional internal threading to engage the external threading on the bolt elements. In addition, or alternatively, as will be explained herein, casement nut elements may be used together with or in lieu of conventional nut elements to both reinforce and accommodate the relatively long, thin configuration of the hanger bolts. In this regard, casement nuts will be seen to comprise an elongated sleeve-like structure having screw threads on the interior of the sleeve to engage the exterior threads of the hanger bolt. If desired, the casement nut sleeve may have a radially extending exterior flange at one end that can be abutted against an exterior surface of a rib element to draw the head of the hanger bolt toward the rib or, the sleeve may have threads extending to and accessible at each end thereof with threads formed on the exterior surface as well as on the interior surface so that a hanger nut element with a relatively large diameter central threaded opening can be threadedly engaged with the exterior of the casement nut and abutted against a rib element to draw the head of the hanger bolt toward the rib element. Although it is possible to use just one single type of bolt for both the rib-bolts and the hanger bolts, it is considered preferable to use a different bolt configuration for each application so as to best accommodate the different requirements and stress to which each is subject in the practical use of this invention, as outlined above and as will be further explained herein.

These and other and further features and advantages of this invention will be made more apparent to those having skill in this art, by reference to the following specification considered in conjunction with the accompanying drawings, in which:

DETAILED DESCRIPTION OF THE DISCLOSED EMBODIMENT

Figure 1:
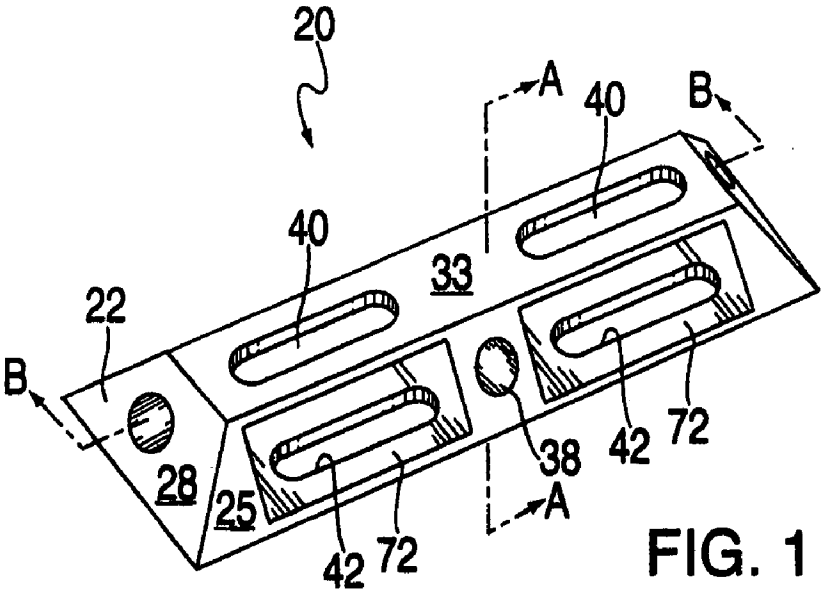
FIG. 1 is a pictorial representation of a rib element that forms part of a wall system in accordance with this invention.
Figure 3:
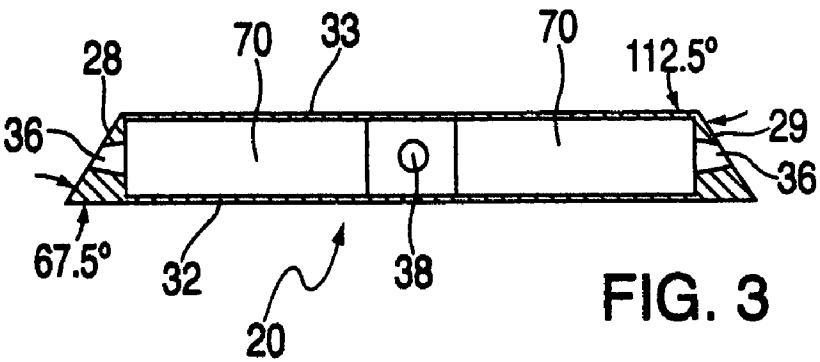
FIG. 3 is an axial cross section of the rib element of FIG. 1, taken in the direction B—B.
Figure 2:
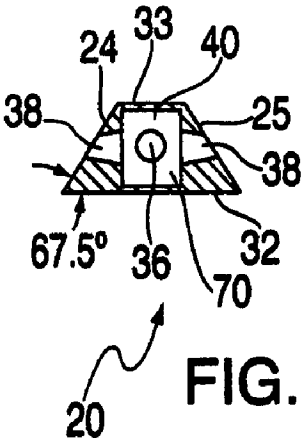
FIG. 2 is a transverse cross section of the rib element of FIG. 1, taken in the direction A—A.

Referring now to FIGS. 1, 2 and 3 of the drawings, the rib elements 20 of this invention can be seen to have an elongate beam-like shape comprising a plurality of wall members 22 including at least a pair of elongate, convergingly related side walls 24, 25, and a pair of transverse convergingly related end walls, 28, 29 extending between side walls 24, 25 at the opposite ends of rib 20. The structure of the disclosed rib element 20 is completed by a second pair of elongate sidewalls 32, 33 extending between sidewalls 24, 25 along the opposite elongate edges of each and between end walls 28, 29 on the opposite edges of the end walls that extend from one of converging sidewalls 24, 25 to the other.

Further in accordance with this invention, the second pair of side walls 32, 33 of rib element 20 comprises a base wall 32 and a crown wall 33 that are disposed in substantially parallel, spaced apart relationship at the top and bottom of beam-like rib 20. As seen most clearly in FIG. 2, the transverse width of crown wall 33, that is the dimension extending between the upper edges of side wall surfaces 24, 25, is less than the corresponding transverse width dimension between the lower edges of the side wall surfaces at base wall 32. This difference in width dimensions is illustrated most clearly in the trapezoidal cross-section of rib 20, shown in FIG. 2. In turn, the trapezoidal cross section results from the sloping, i.e. converging, relationship of side wall surfaces 24,25.

With reference to the structure of ribs 20 thus far described and illustrated, it should be noted that although a relatively short rib having a length of say, 12 or 16 inches, is shown, ribs of any desired and suitable length up to several feet, may be created and employed, if desired. For ribs having a substantial length, additional access openings 72, and bolt-receiving openings 38, as well as hanger bolt openings 94, may be provided as the length of side walls 24, 25 and 32, 33 increase. Desirably, the spacing between spaced-apart openings along the length of these sidewalls will be made consistent and uniform for all lengths of ribs 20 so as to provide the modularity of spacing and assembly that is an underlying feature of this invention now made apparent by this disclosure.

It will be understood readily by those of ordinary skill in the art that the angle formed by sloping side walls 24, 25 and base wall 32, as shown in FIG. 2, can be of any desired value. It will be understood further that the angle defined at the intersection of end wall surfaces 28 and 29 with base wall surface 32 similarly may be of any desired value. However, an angle of 67.5 degrees is considered preferable for the intersection of the sidewall surfaces 24, 25 as well as end wall surfaces 28, 29 with base wall surface 32 for the purposes of this invention. It can be seen that two trapezoidal shapes having equal base angles of 67.5 degrees can be abutted in side-by-side relationship, with the base angles adjacent each other, to dispose the adjacent base surfaces at an angle of 135 degrees relative to each other, and accordingly, the base surface of a third trapezoidal shape abutted against the remaining outside surface of either one of the first two, again with base angles in adjacent relationship, will result in the two outermost base surfaces being disposed at an angle of 90 degrees relative to each other. Still further, it will be understood that a "regular" trapezoid, i.e. one with equal base angles of 67.5 degrees will have equal "crown" angles of 112.5 degrees. For the purposes of this invention, the "crown" angle is considered to be the angle defined by the intersection of crown wall 33 with any one of end walls 28, 29 or side walls 24, 25.

In accordance with basic geometrical analysis it is evident that the trapezoidal shapes incorporated into the rib elements of this invention make it possible to abut the rib element walls in combinations that create both angular and straight, or "linear", joints. That is, the base angle and the crown angle in a trapezoid are complementary in that their sum is 180 degrees, i.e. a straight line. And, the sum of two base angles is 135 degrees, which is the complement of 45 degrees. Accordingly, when two ribs are abutted together with the base angle of one adjoining the crown angle of the other, the adjacent exterior sides of the ribs will define a straight line; and correspondingly, if three ribs are abutted together in series, with their base angles in adjacent relationship, the base surfaces of the two outermost ribs will define a right angle relative to each other.

To achieve the desired connections between abutting rib elements, each element includes various bolt-receiving openings in combination with access openings that permit insertion of fastener bolts 50 as well as assembly of threaded fastener nuts 60 onto the ends of the bolts. As shown most clearly in FIG. 1 of the drawings, each end wall 28, 29 includes a central, bolt-receiving through-hole 36. And, as illustrated in the cross-section of FIG. 3, bolt-receiving openings 36 have the shape of truncated conical sections, flaring outwardly from a given diameter in wall surface 28, 29 toward a wider diameter at the interior of the rib.

Figure 4:
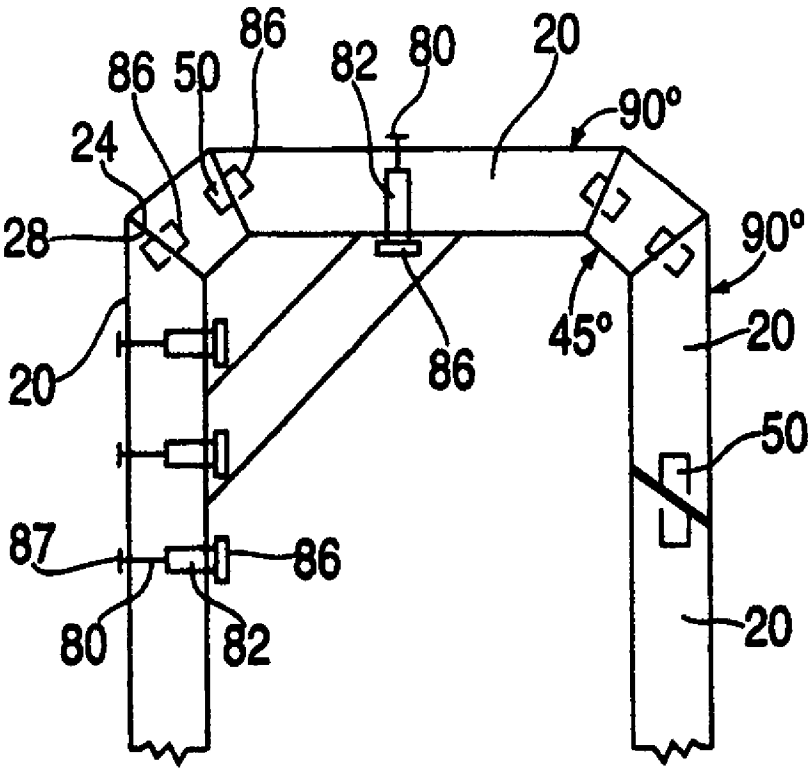
FIG. 4 is a partial sectional detail view showing a joint coupling several rib elements to each other as they would appear in a framework in accordance with this invention.
Figure 8B:
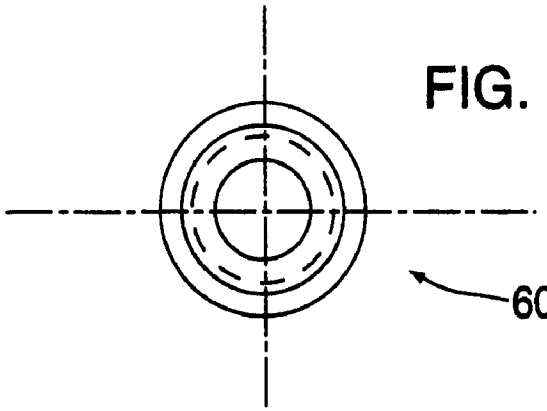
FIGS. 8A and 8B are side and end views, respectively, of a threaded casement nut fastener for use with the bolt elements of this invention.
Figure 8A:
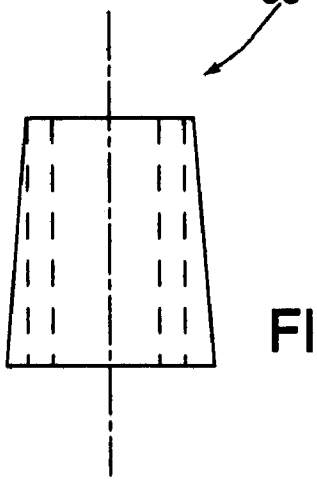

In accordance with this invention and with the unique disclosed function of coupling rib elements 20 to each other with their corresponding axial and/or transverse axes disposed either in line or at an angle to each other, the tapered shape of bolt receiving openings 36 permits threaded fastener bolt members 50 to be inserted into openings 36 at an angle relative to the axis of the opening as well as relative to the longitudinal axis of the rib element. In this regard, threaded fastener nut elements 60 (see FIGS. 8A and 8B) are also tapered in shape from one end to the other to facilitate wedging of the nut 60 within the bore 36 as the nut enters through the wider open end of the bore within ribs 20, when two adjacent ribs are fastened together by means of the bolt 50 and a nut 60 at each end of the bolt. To simplify xx For the purposes of this invention, it will be understood that bolts of more conventional design (not shown) having a head portion, preferably tapered, at one end and a threaded body portion at the other end, may be used in certain applications of the invention. However, when it is desired to fasten two rib elements 20 together as shown, for example, in FIG. 4, it will be preferable to employ headless bolts 50 which may be engaged by nut elements 60 at opposite ends thereof to facilitate insertion of the bolts into the restricted but accessible interior spaces 70 provided by the illustrated access openings 72 in and/or between sidewalls 24, 25.

In addition to axial bolt-receiving openings 36, each rib element 20 may be seen to incorporate other openings 38, 40 and 42 in the side walls 24, 25, base walls 32 and crown walls 33 thereof. Openings 38, in side walls 24, 25, illustrated most clearly in FIGS. 1, 2 and 3 of the drawings, can be seen to have substantially the same shape and serve the same function as bolt-receiving openings 36 in end walls 28, 29. That is openings 38 taper outwardly from a narrower opening at the outer surface of the side walls to a wider opening in the interior of the rib. The tapered shape of openings 38 serves the same function as the tapered shape of openings 36, namely permitting skewing of the axis of an inserted bolt 50 to accommodate angular displacement of the axes of adjoining openings coupled by a common bolt. The tapered shape of openings 38 further accommodates "nesting" and wedging of tapered nut elements 60 within the holes.

By contrast with the bolt-receiving openings, substantially enlarged access openings 72 in side walls 24, 25 are provided for the purpose of allowing access to the interior spaces 70 of rib elements 20 so that nuts 60 may be manipulated and tightened, manually or otherwise, onto the ends of bolts 50. It will be understood readily by those having skill in the art, that the shape of openings 72 need not be rectangular or any specific shape whatsoever, provided only that the openings are sufficient in size to permit insertion and tightening of nut elements 60 on the ends of fastener bolts 50 within the interior of the rib structure.

Still further and finally with reference to openings in the walls of ribs 20, crown walls 33 and base walls 32 may be seen to include axially elongate slot-shaped bolt-receiving openings 40, 42. In accordance with the disclosed use and functions of this invention, openings 40 in crown wall 33 are aligned with openings 42 in base walls 32 so that hanger bolts 80, shown in FIG. 7, may extend completely through a rib element 20 from the crown wall side 33 to the base wall side 32 (and vice versa).

Where the free end 83 of hanger bolt 80 extends beyond rib 20, a nut element 60 or any other suitable form of threaded nut device may be threaded onto the free end to tighten the bolt against the rib. For the purpose of conveniently tightening a hanger bolt 80 relative to a rib element 20, it should be noted that any threaded nut element may serve this purpose, but for the purposes of this invention, a casement nut member 82 with a flange or in combination with a fastener nut is deemed preferable. In this regard, a casement nut 82 has an elongated tubular shape that is, a sleeve-like shape, that is threaded internally to engage the threaded body of hanger bolt 80 in conventional threaded relationship, while the exterior surface of nut 82 is threaded also to receive an assembly nut member 86 in similarly conventional threaded relationship. For convenience in actual use, assembly nut member 86 may have a conventional, e.g. hexagonal nut shape or may be interchangeable with assembly nut member 60 so as to reduce the number of different parts required for use and assembly of walls in accordance with the invention. In the alternative, casement nut 82 may be provided with a radially extending flange, not shown, at one end thereof to serve as an abutment that directly engages an outer surface of a rib member and eliminates the need for an assembly nut 86 to serve this purpose.

To facilitate manipulation and rotation of casement nut 82 as it is threaded onto hanger bolt 80, an axial driver portion 85 may be provided with a non-threaded exterior surface that can be engaged easily either manually or with any suitable conventional tool; axial portion 85 is shown extending axially from one end of nut 82, but it should be understood readily that such driver portions may be provided alternatively at both ends of the nut or at any portion of the length of the nut intermediate its ends, if desired.

For the purposes of this invention, the diameter of the threaded body portion of hanger bolt 80 may be substantially less than the diameter of fastener bolts 50, and accordingly the outer threaded diameter of casement nut 82 may be made equal to the diameter of fastener bolts 50, so that tapered nut elements 60 may be used to engage both fastener bolts 50 and casement nut members 82. Although this arrangement is considered preferable, it should be appreciated that various other and different dimensions may be adapted without departing from the spirit and scope of this invention. A significant advantage of the elongate casement nut configuration is that it is expected that hanger bolts 80 frequently will require substantial lengths, on the order of 12 inches or more, and the casement nut, which can be provided with a significant, but lesser length, on the order of 3 or 4 inches for example, will serve to enhance the tensile strength and rigidity of the hanger bolt especially in the localized area where such enhancement is most needed; namely, at the point where an anchor nut 60 is used to apply force to tighten the hanger bolt relative to a rib 20.

Figure 5:
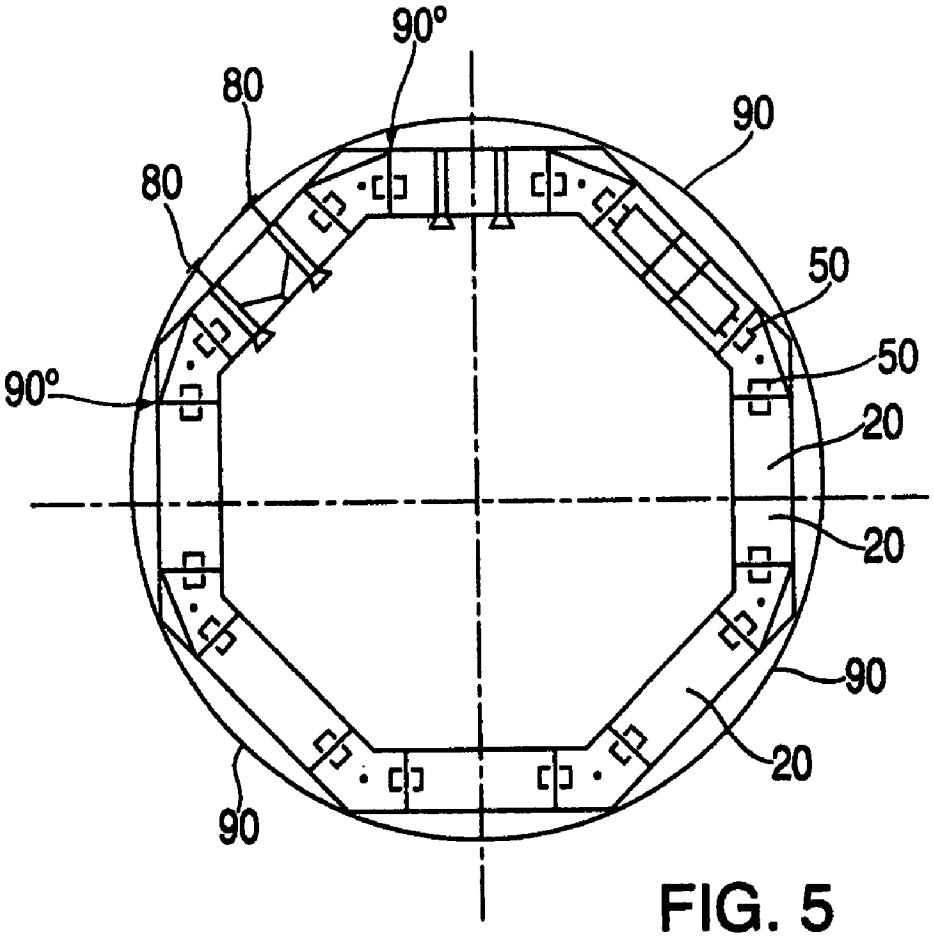
FIG. 5 is a partial cross-sectional view of a supporting wall constructed in accordance with this invention.

As illustrated in one form in FIG. 5, the structural outer skin elements 90 of this invention (shown in detail in FIG.

6) are "hung" on a framework of ribs by hanger bolts 80 which are positioned to extend through a hanger bolt opening 94 in each of one or more skin members 90 and through hanger bolt slots 40, 42 in ribs 20. As described above, hanger bolts 80 may be tightened relative to ribs 20 by applying a suitable fastener nut 86 directly to the threaded exterior of bolt 80 or by positioning a casement nut 82 on the exterior of bolt 80 and then applying a fastener nut 86 to the threaded exterior of casement nut 82.

Figure 6A:
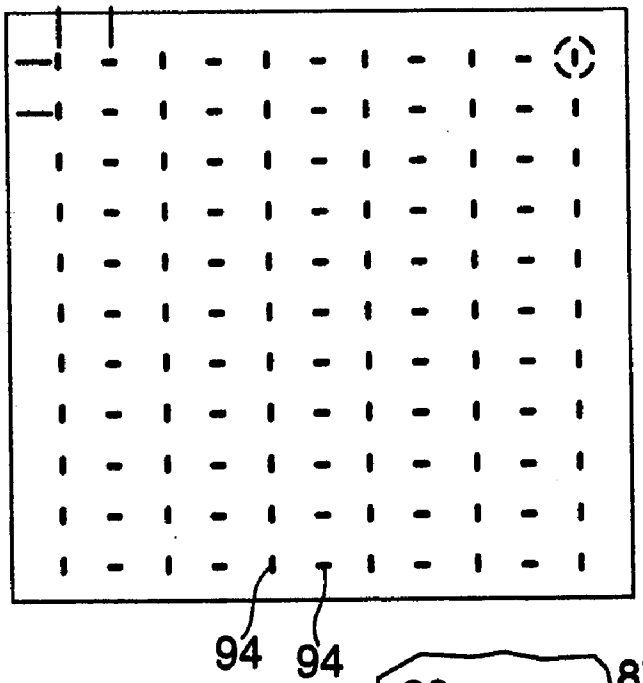
FIG. 6A is a plan view of a skin element sheet in accordance with this invention.
Figure 6B:
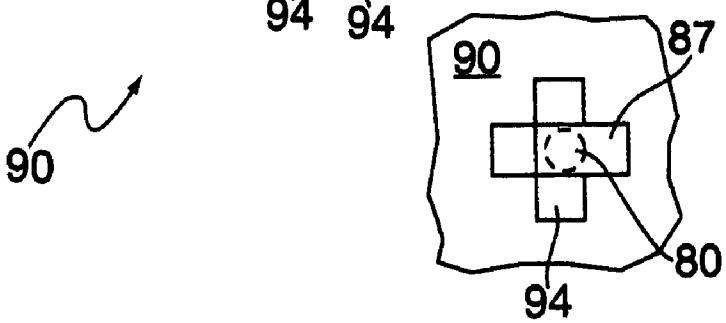
FIG. 6B is a partial detail plan view of an opening in the skin element of FIG. 6 with a hanger bolt in a given position relative thereto.
Figure 7B:
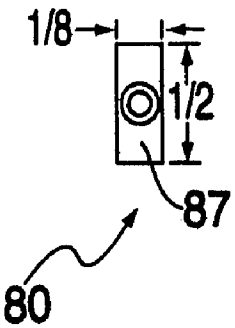
FIG. 7B is an end view of the hanger bolt of FIG. 7A, showing the shape of the head portion of the bolt.
Figure 7A:
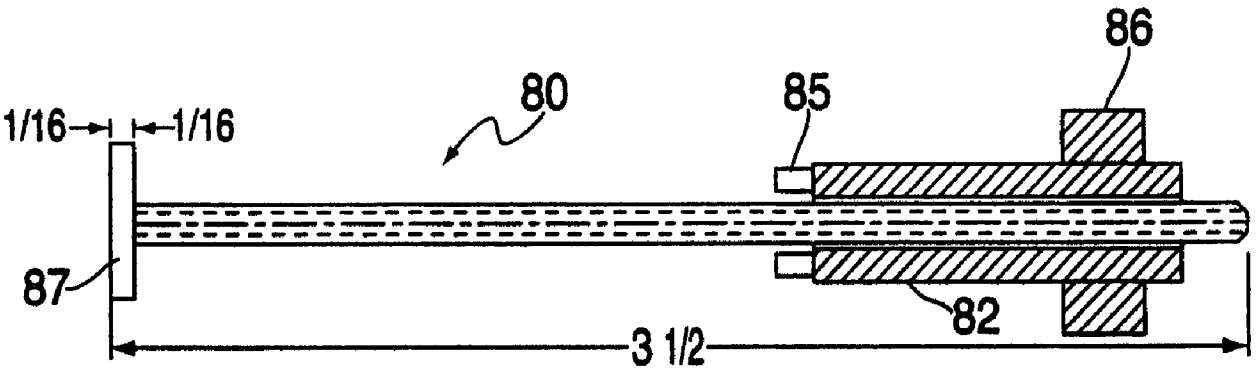
FIG. 7A is a side view of a threaded hanger bolt for securing skin elements to rib elements in accordance with this invention.

A feature of this invention is the unique way in which hanger bolts 80 are engaged to skin elements 90. As shown generally in FIG. 6, each skin member 90 incorporates a plurality of slot-shaped hanger bolt openings 94 arranged in a substantially uniform array that preferably has the form of a coordinate grid. The openings 94 are located over substantially the entire surface of each sheet 90 so that hanger bolts 80 may be engaged with the surface of the skin at or very close to any desired position on the skin. A further unique aspect of the engagement of bolts 80 with skin elements 90 is the relative shapes of the heads 87 of bolts 80 and the hanger bolt openings 94 in sheets 90. FIGS. 6A and 7B illustrate that the shapes are substantially identical, subject to the understanding that openings 94 are dimensioned to be sufficiently larger than the dimension of bolt heads 87, so that the bolt heads 87 may pass through openings 94 in either direction when the two have been properly aligned with each other. FIG. 6B illustrates how the head 87 of a hanger bolt 80 may be positioned transversely to the axial length of slot-shaped opening 94 so that head 87 engages the surface of sheet 90 circumjacent opening 94 and prevents the head from passing through the sheet. It will now be understood that hanger bolt 80 may be rotated about the central axis of the bolt, when desired, to position bolt head portion 80 in axial alignment with the axial length of opening 94; as a feature of this invention, bolt head portions 87 are dimensioned to pass freely through openings 94 when the head and the opening are aligned in this first position, and to preclude passage of the head portion through the opening when the two are positioned in the second position, illustrated in FIG. 6B. Accordingly, assembly of a wall in accordance with this invention can be achieved by first positioning hanger bolts 80 in desired positions on a framework constructed of ribs 20, with the threaded portions of the hanger bolts extending through selected hanger bolt-receiving openings 40, 42 in the ribs of the framework and with the head portions 87 of the hanger bolts 80 positioned on the outer side of the frame where the skin will be mounted. When skin elements 90 are placed in position on the outside of the frame of ribs 20, the heads 87 of hanger bolts 80 are first aligned to pass through the openings 94 and then rotated to the position shown in FIG. 6B to prevent the heads from being withdrawn from engagement with the skin 90 when bolts 80 are later tightened (i.e. bolted) to ribs 20. It should be readily understandable, now, that the head portion 87 of a single bolt 80 can be extended in this manner through more than one sheet element 90, so that two or more overlying sheet elements can be fastened to each other and to a common rib element by a single hanger bolt 80, as illustrated in FIG. 5.

Although a preferred embodiment of the invention has been illustrated and described, it will be obvious to those having skill in this art that various other forms and embodiments of the invention now may be visualized, readily, by those having skill in this art, without departing substantially from the spirit and scope of the invention set forth in the accompanying claims.

What is claimed is:

1. A support/enclosure wall system comprising:

a plurality of elongate rib members separably attachable to each other for defining a framework;

said rib members each having a plurality of wall members, said wall members including at least a pair of convergingly related side walls and a pair of convergingly related end walls, said wall members having bolt-receiving openings therethrough;

a plurality of threaded fastener bolt members dimensioned to extend through said bolt-receiving openings to secure one of said rib members to another of said rib members;

a first one of said rib members being secured to a second one of said rib members with one of said convergingly related side walls of said first rib member disposed in abutting relationship with a first one of said convergingly related end walls of said second rib;

a third one of said rib members being secured to said second one of said rib members with one of said convergingly related side walls of said third rib member disposed in abutting relationship with the one of said convergingly related end walls of said second rib remote from said first one of said end walls thereof;

said first and second rib members being secured together by a first one of said fastener bolt members extending through one of said bolt-receiving openings in said first rib member and one of said bolt-receiving openings in said second rib member;

said second and third rib members being secured together by a second one of said fastener bolt members extending through one of said bolt-receiving openings in said second rib member and one of said bolt-receiving openings in said third rib member;

a plurality of structural outer skin members formed of stiffly flexible sheet material, each skin member having a plurality of elongate, hanger bolt-receiving openings therethrough arranged in a regular pattern;

a plurality of threaded hanger bolt members each having a body portion dimensioned to extend through said hanger bolt-receiving openings in said outer skin members and through said bolt-receiving openings in said rib members, and a head portion configured to pass entirely through said hanger bolt-receiving openings when said head portion and said hanger bolt-receiving opening are aligned in a first angular orientation relative to each other and, in a second angular orientation relative to each other, to abut against a portion of the surface of said skin members adjacent said hanger bolt-receiving openings to preclude passage of said head portion through said hanger bolt-receiving opening;

a first one of said outer skin members being fastened to said first rib member by means of a first one of said hanger bolt members extending through a first one of said hanger bolt-receiving openings in said first outer skin member and through at least one of said bolt-receiving openings in said first rib member, said first one of said outer skin members further being fastened to said third rib member by means of a second one of said hanger bolt members extending through a second one of said hanger bolt-receiving openings in said first outer skin member and through one of said bolt-receiving openings in said third rib member;

a second one of said outer skin members being fastened to said third rib member by means of said second one of said hanger bolt members further passing through a first one of said hanger bolt-receiving openings in said second outer skin member.

2. A support/enclosure wall system in accordance with claim 1, wherein:

said plurality of hanger bolt-receiving openings have the form of elongated slots.

3. A support/enclosure wall system in accordance with claim 2, wherein:

said hanger bolt-receiving openings in each skin member are arranged in a coordinate-grid pattern with the elongate axes of alternating ones of said slots being oriented at an angle to the axes of adjacent ones of said slots.

4. A support/enclosure wall system in accordance with claim 3, wherein:

said alternating ones of said slots are oriented at a right angle to each other.

5. A support/enclosure wall system in accordance with claim 1, wherein:

said wall members of said rib members further include an elongate crown wall extending between said convergingly related sidewalls along one edge of each of said side walls and a base wall extending between said convergingly related side walls along an opposite edge of each of said side walls, one of said end walls being coupled to each of said side walls, said base wall and said crown wall at one end thereof and the other of said end walls being coupled to the opposite end of each of said side walls, said base wall and said crown wall.

6. A support/enclosure wall system in accordance with claim 1, wherein:

said one of said bolt-receiving openings in said first rib member is one of said axially elongate slots in said base wall of said first rib member and said first one of said hanger bolt members further extends through one of said axially elongate slots in said crown wall of said first rib member.

7. A support/enclosure wall system in accordance with claim 5, wherein:

said pair of convergingly related side walls converge toward each other from said base wall toward said crown wall.

8. A support/enclosure wall system in accordance with claim 5, wherein:

said pair of convergingly related side walls converge toward each other from said crown wall toward said base wall.

9. A support/enclosure wall system in accordance with claim 5, wherein:

said pair of convergingly related end walls slope inwardly toward each other from said base wall toward said crown wall.

10. A support/enclosure wall system in accordance with claim 5, wherein:

said bolt-receiving openings in said base wall and said crown wall have the form of axially elongate slots.

11. A support/enclosure wall system in accordance with claim 1, wherein:

said rib members are characterized by a substantially trapezoidal transverse cross section having a base lying in said base wall, a crown lying in said crown wall and a pair of opposed, spaced-apart sides each lying respectively in one of said side walls.

12. A support/enclosure wall kit comprising:

a plurality of elongate rib members separably attachable to each other for defining a framework;

said rib members each having a plurality of spaced apart wall members, said wall members including at least a pair of convergingly related sidewall surfaces, and a pair of convergingly related end wall surfaces, said wall members having bolt-receiving openings therethrough and said rib members having access openings therein providing manual access to the spaces between said wall members;

a plurality of structural outer skin members formed of stiffly flexible sheet material, each skin member having a plurality of elongate, substantially slot-shaped hanger bolt-receiving openings therethrough arranged in a regular pattern spaced uniformly over the surface of each of said skin members;

a plurality of threaded fastener bolt members dimensioned to extend through said bolt-receiving openings to secure a first one of said rib members to a second one of said rib members with one of said wall members of each of said rib members disposed in abutting relationship with one of said wall members of the other of said rib members;

a plurality of threaded hanger bolt members dimensioned to extend through said hanger bolt-receiving openings in said outer skin members and through said bolt-receiving openings in said rib members to fasten said skin members to said rib members;

said hanger bolt members each having a threaded body portion, and a slot-shaped head portion at one end of said body portion dimensioned to pass through said hanger bolt-receiving openings when said slot-shaped head portion is oriented in a first position relative to said openings and to abut against the surface of said skin member circumjacent said openings when oriented in a second position relative to said openings.

13. A support/enclosure wall kit in accordance with claim 12, wherein:

said hanger bolts are dimensioned to be freely rotatable about their axes when said body portion is disposed within said bolt receiving opening to move said hanger bolt head portions from said first position to said second position.

14. A support/enclosure wall kit in accordance with claim 12, wherein:

said rib members each further include an elongate crown wall extending between said convergingly related sidewall surfaces along one edge of each of said side wall surfaces and a base wall extending between said convergingly related side wall surfaces along an opposite edge of each of said side wall surfaces, one of said end wall surfaces being coupled to each of said side wall surfaces, and to said base wall and said crown wall at one end thereof and the other of said end wall surfaces being coupled to the opposite end of each of said side wall surfaces, and to the opposite end of said base wall and said crown wall.

15. A support/enclosure wall kit in accordance with claim 12, wherein:

said crown wall and said base wall further include axially elongate slot openings therethrough for receiving said hanger bolts therein and permitting said hanger bolts to extend through said rib members from one side thereof to an opposite side thereof.

16. A support/enclosure wall kit in accordance with claim 12, further comprising:

a plurality of threaded nut elements for threadedly engaging said fastener bolt members to fasten at least two adjacent rib members to each other relative to a fastener bolt member, each of said nut elements having a tapered conical exterior for nesting within said bolt receiving openings.

* * * * *